US006641487B1

(12) United States Patent
Hamburger

(10) Patent No.: US 6,641,487 B1
(45) Date of Patent: Nov. 4, 2003

(54) ADJUSTABLY WEIGHTED GOLF CLUB PUTTER HEAD WITH REMOVABLE FACEPLATES

(76) Inventor: Edward Hamburger, 4730 Morris Lake Cir., West Bloomfield, MI (US) 48323

( * ) Notice: Subject to any disclaimer, the term of this patent is extended or adjusted under 35 U.S.C. 154(b) by 0 days.

(21) Appl. No.: 09/809,633

(22) Filed: Mar. 15, 2001

Related U.S. Application Data

(60) Provisional application No. 60/189,545, filed on Mar. 15, 2000.

(51) Int. Cl.[7] ..... A63B 53/06

(52) U.S. Cl. ..... 473/288; 473/334; 473/337; 473/340

(58) Field of Search ..... 473/333, 334, 473/335, 336, 337, 338, 339, 244, 245, 246, 247, 248, 288, 325, 324, 342, 340, 341, 313, 305

(56) References Cited

U.S. PATENT DOCUMENTS

| | | | | |
|---|---|---|---|---|
| 4,121,832 | A | | 10/1978 | Ebbing |
| 4,325,553 | A | | 4/1982 | Taylor |
| 4,506,888 | A | | 3/1985 | Nardozzi, Jr. |
| 4,529,202 | A | | 7/1985 | Jacobson |
| 4,569,523 | A | | 2/1986 | Jarvis |
| 4,730,830 | A | * | 3/1988 | Tilley |
| 4,828,266 | A | * | 5/1989 | Tunstall |
| 4,844,468 | A | | 7/1989 | Lee |
| 4,872,684 | A | | 10/1989 | Dippel |
| 4,884,808 | A | * | 12/1989 | Retzer |
| 4,948,132 | A | * | 8/1990 | Wharton |
| 4,962,932 | A | | 10/1990 | Anderson |
| 5,244,210 | A | * | 9/1993 | Au |
| 5,292,123 | A | | 3/1994 | Schmidt, Jr. et al. |
| 5,390,918 | A | | 2/1995 | Meyers et al. |
| 5,407,196 | A | | 4/1995 | Busnardo |
| 5,431,401 | A | * | 7/1995 | Smith |
| 5,437,447 | A | | 8/1995 | Rigutto |
| 5,439,222 | A | | 8/1995 | Kranenberg |
| 5,462,279 | A | | 10/1995 | Culpepper |
| 5,533,725 | A | | 7/1996 | Reynolds, Jr. |
| 5,542,665 | A | | 8/1996 | Levocz et al. |
| 5,603,666 | A | | 2/1997 | Bowe |
| 5,716,287 | A | | 2/1998 | Levocz et al. |
| 5,746,664 | A | | 5/1998 | Reynolds, Jr. |
| 5,803,824 | A | | 9/1998 | Rollingson |
| 5,803,825 | A | * | 9/1998 | Hamilton |
| 5,839,974 | A | | 11/1998 | McAllister |
| 5,863,257 | A | | 1/1999 | Busnardo |
| 5,906,549 | A | * | 5/1999 | Kubica |
| 5,921,871 | A | | 7/1999 | Fisher |
| 5,924,938 | A | | 7/1999 | Hines |
| 5,997,409 | A | | 12/1999 | Mattson |

* cited by examiner

*Primary Examiner*—Sebastiano Passaniti
(74) *Attorney, Agent, or Firm*—MacMillan, Sobanski & Todd, LLC

(57) ABSTRACT

A golf club head includes a body adapted to be connected to a shaft. The body has a plurality of cavities formed therein for receiving weights to alter the weight characteristic of the golf club head. One of a plurality of different faceplates are adapted to be removably fastened to the body.

27 Claims, 4 Drawing Sheets

Fig. 4
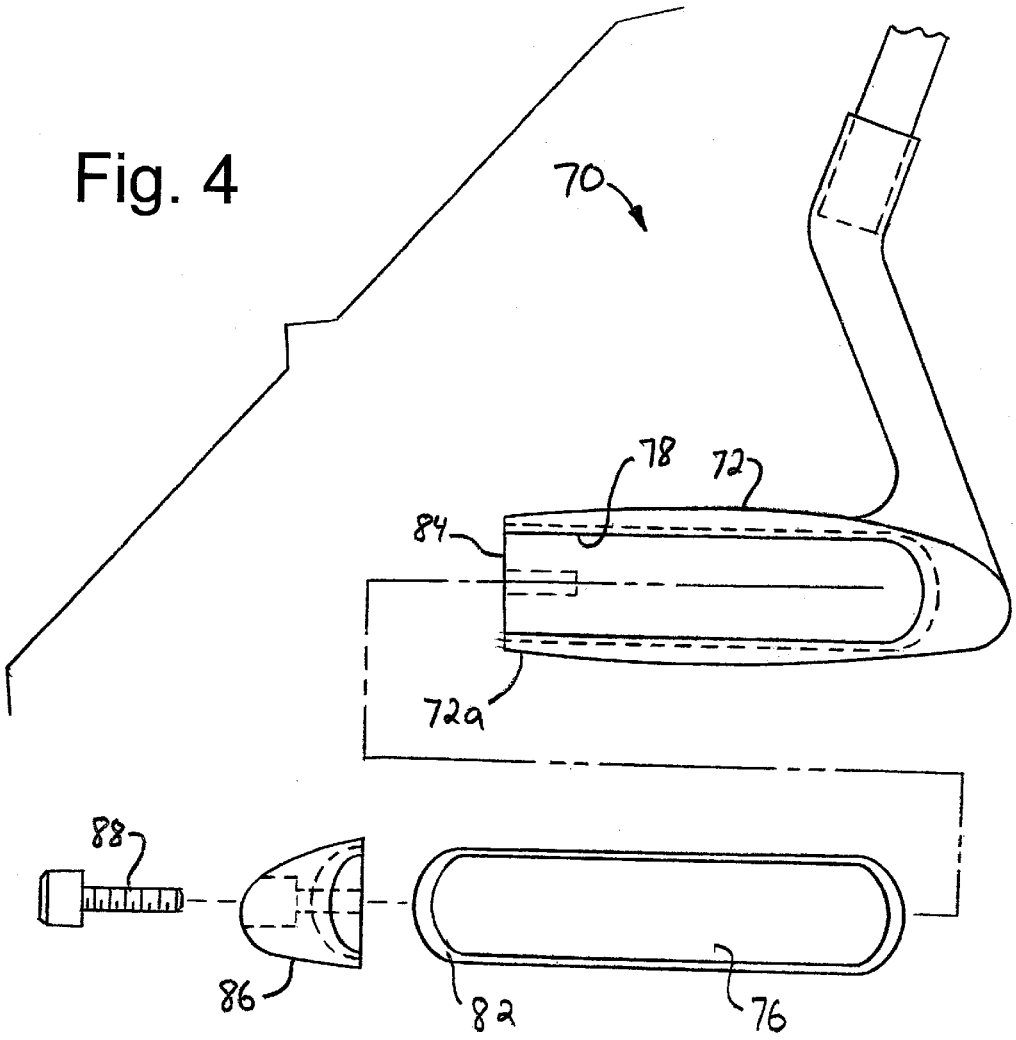
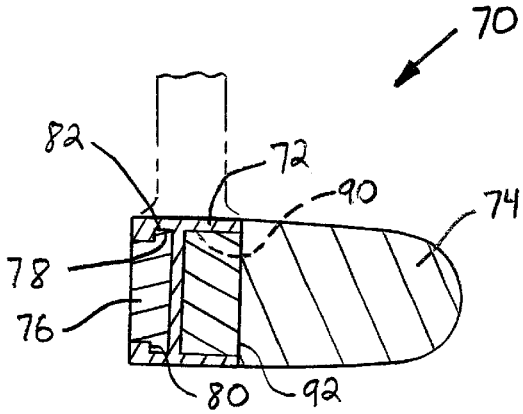
Fig. 5

ADJUSTABLY WEIGHTED GOLF CLUB PUTTER HEAD WITH REMOVABLE FACEPLATES

CROSS REFERENCE TO RELATED APPLICATIONS

This application claims the benefit of U.S. Provisional Application No. 60/189,545 filed Mar. 15, 2000.

BACKGROUND OF THE INVENTION

This invention relates in general to golf clubs, and in particular to an adjustably weighted golf club putter head adapted to receive one of a plurality of removable faceplates.

Golf club putters generally include a shaft, a hand grip attached to one end of the shaft, and a putter head attached to the other end of the shaft. Putter heads include a body which is adapted to be fastened to the shaft. The putter head defines a striking surface which makes contact with a golf ball during use thereof. Most of the conventional putter heads are constructed and formed from a single component, such as a metal casting. However, these types of putter heads cannot be altered after manufacturing to change certain characteristics of the putter head. Examples of characteristics of the putter head include the shape, density, or elasticity of the striking face. Another characteristic is the weight distribution of the putter head. One of the disadvantages of conventional putter heads formed of a single structure is that they cannot be easily altered. Therefore, the manufactures of golf clubs often produce many different types of styles of golf club putters to chose from. However, it is relatively expensive to inventory the different types of styles of putter heads to accommodate the different consumer preferences.

SUMMARY OF THE INVENTION

This invention relates to a golf club adapted to alter the weight characteristics of the head, as well adapted to receive one of a plurality of replaceable faceplates. The club head includes a head having a body adapted to be connected to a club shaft. The body has a plurality of cavities formed therein for receiving weights to alter the weight characteristic of the golf club head. One of a plurality of different faceplates are adapted to be removably fastened to the body.

Various objects and advantages of this invention will become apparent to those skilled in the art from the following detailed description of the preferred embodiment, when read in light of the accompanying drawings.

BRIEF DESCRIPTION OF THE DRAWINGS

FIG. 4 is an exploded front elevational view of a second embodiment of a putter head, in accordance with the present invention.

FIG. 5 is a cross-sectional side view of the putter head of FIG. 4.

DETAILED DESCRIPTION OF THE INVENTION

Figure 1:
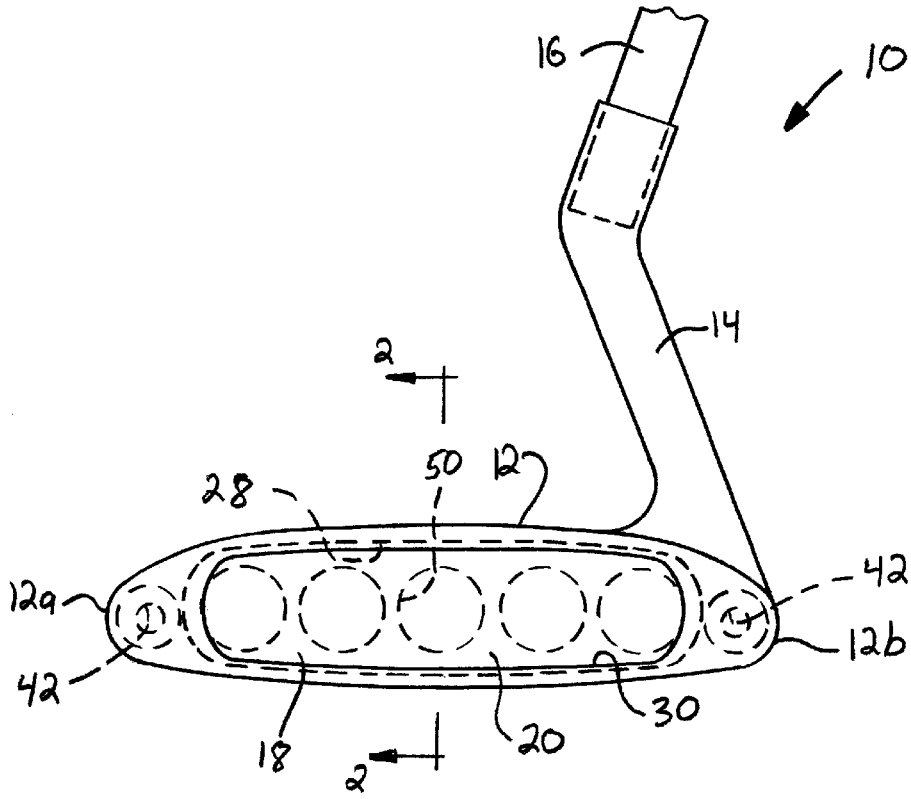
FIG. 1 is front elevation view of a first embodiment of a golf club putter head, in accordance with the present invention.
Figure 2:
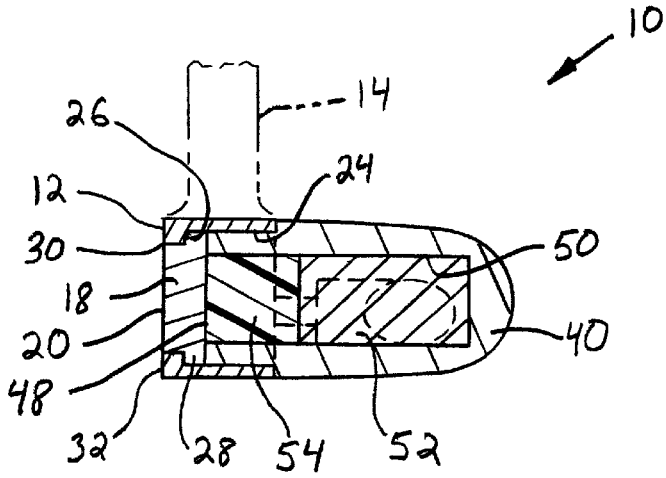
FIG. 2 is a cross-sectional side view of the putter head of FIG. 1, generally taken along Lines 2—2.
Figure 3:
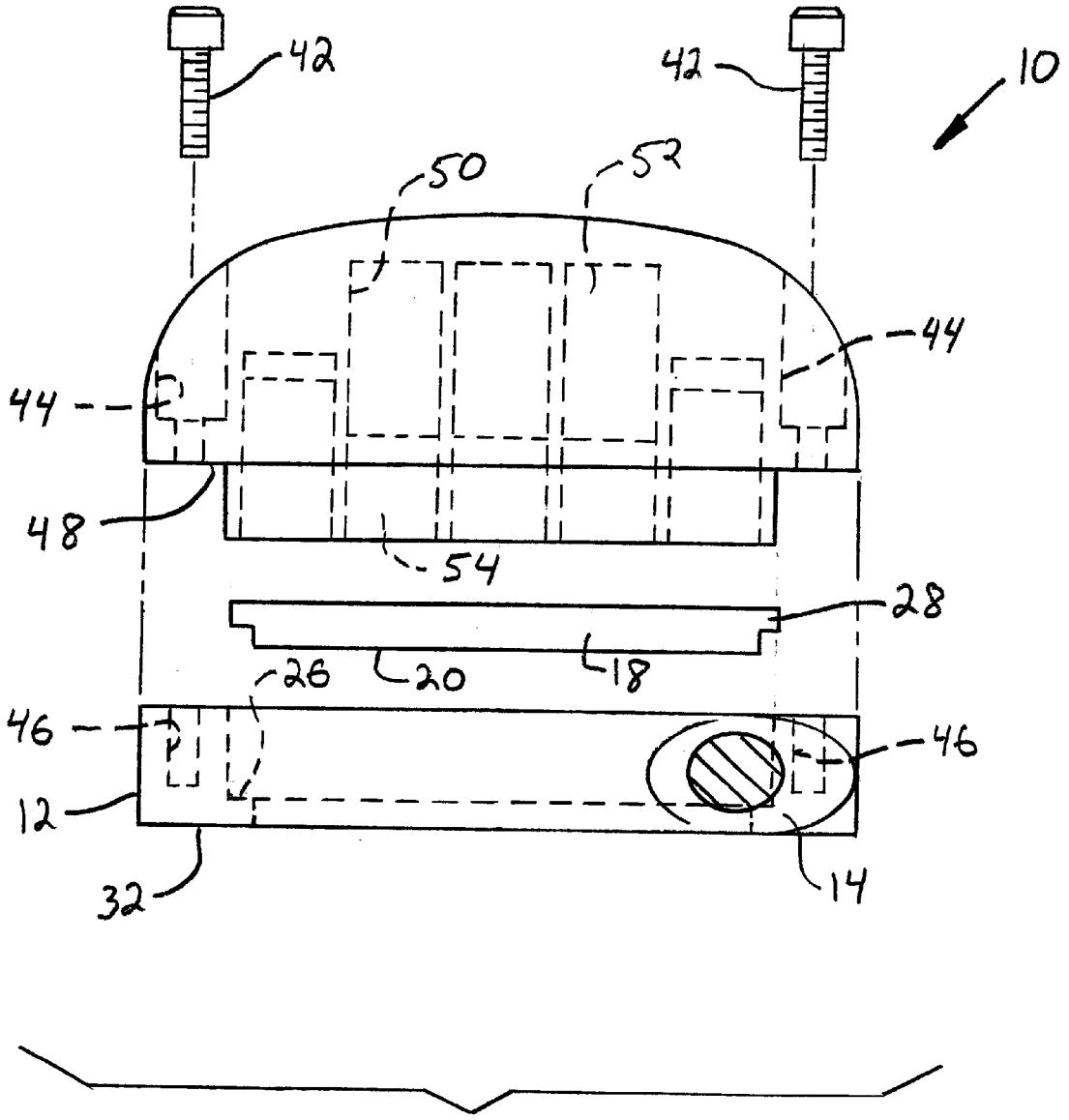
FIG. 3 is an exploded top plan view of the putter head of FIG. 1.

Referring now to the drawings, there is illustrated in FIGS. 1 through 3, a first embodiment of a putter head, indicated generally at 10. The putter head 10 and the structures thereof can be formed of any suitable material, such as metal or plastic. The head 10 includes a body 12 having a hosel extension 14 extending upwardly therefrom. The hosel extension 14 provides means for attaching a club shaft 16 to the body 12. The shaft 16 can be attached to the body 12 by any suitable manner. If desired, the shaft 16 can be attached to the body 12 without using a hosel extension 14.

The putter head 10 also includes a faceplate 18 removably attached to the body 12. The faceplate 18 includes a striking surface 20 for contacting a golf ball during use of the putter head 10. The putter head 10 is adapted to include one of a plurality of faceplates having different characteristics. For example, the faceplates can have striking surfaces which have different shaped faces, such as curved or flat. The faceplates can also have different materials at their respective striking surfaces, such as titanium, brass, plastic, or any other desirable material. If desired, the faceplates can include separate striking surface inserts (not shown) of different elasticity than the remaining portion of the faceplate.

Preferably, a plurality of different faceplates are provided by the seller of the putter head 10, such as a pro shop, such that the consumer of the putter head 10 selects a desired faceplate. Thus, many different combinations of putters can be constructed with a common body 12 and a plurality of faceplates to produce a customized putter. The putter head 10 may also be sold with a plurality of face plates, so that the consumer can change them when desired.

The faceplate 18 can be removably fastened to the body 12 by any suitable manner. As shown in FIG. 2, the body 12 includes a stepped through bore 24 defining a shoulder 26. The faceplate 18 includes an outwardly extending flange 28 formed around the perimeter thereof. The flange 28 engages and contacts the shoulder 26. The flange 28 has a complimentary shape relative to the shoulder 26 of the body 12.

The flange 28 engages and contacts the shoulder 26. Preferably, the flange 28 and the shoulder 26 are sized so that the faceplate 18 fits snugly in the bore 24 of the body 12 and does not move in a lateral direction.

The through bore 24 of the body 12 defines an opening 30 in a front face 32 of the body 12. Preferably, the front face 32 is co-planar with the striking surface 20 of the faceplate 18 to form a smooth continuous surface at the front of the putter head 10.

The body 12 preferably is a two-piece design further including a rear portion 40 detachably fastened to the body 12. The rear portion 40 can be detachably fastened to the body 12 by any suitable manner. For example, as best shown in FIG. 3, the putter head 10 can include threaded fasteners 42 which are inserted through bores 44 formed in the rear portion 40 and are threadably engaged with threaded bores 46 formed in the body 12. Any number of threaded fasteners 42 can be used. Preferably, the rear portion 40 is adjacent to and contacts with the faceplate 18 to retain the faceplate 18 within the bore 24 of the body 12. Thus, the faceplate 18 is generally sandwiched between the shoulder 26 and a first surface 48 of the rear portion 40.

The body 12 and the rear portion 40 can have any shape suitable for use as a golf putter head. For example, the depth of the rear portion 40 can be relatively large, as shown in FIGS. 2 and 3, to define a "mallet-type" putter head. Alternatively, the depth of the rear portion 40 can be relatively short to define a "heel-toe type" putter head.

Preferably, the body 12 or the rear portion 40 includes a plurality of cavities 50 formed therein for receiving weights 52 to alter the weight characteristics of the putter head 10, thereby changing the feel and striking characteristics of the putter head 10. The weights 52 can be made of any suitable material, such as relatively heavy metals, for example, lead and tungsten. The weights 52 are preferably heavier than the material of the body 12 and/or rear portion 40 so that the weights 52 can more easily alter the weight characteristics of the head 10. For example, the putter head 10 can be weighted more heavily on the ends, defined as a toe portion 12*a* and a heel portion 12*b*, compared to the center to compensate for off-center or miss-hits to help stabilize the putter head 10 when striking the golf ball. Preferably, the plurality of cavities are oriented in a generally linear manner extending between the heel portion 12*b* and the toe portion 12*a*. The putter head 10 can also be selectively weighted to alter the overall weight of the putter head as desired by the user of the putter. The location of the cavities 50 within the body 12, or the position of the weights 52 within the cavities 50, can be positioned at any suitable location to alter the front and back weight characteristic of the putter head 10.

Preferably, a selection of different weights 52 is initially provided from which suitable weights are selected and positioned within the cavities 50 to obtain the desired feel and striking characteristics of the putter. The weights 52 are preferably sized to snugly fit within the cavities 50. The length of the weights 52 can be less than the depth of the respective cavity 50, so that less weight is distributed in the cavity 50. The remainder or void of the cavity 50 can then be filled with a relatively light weight plastic plug 54 to fill the void of the cavity 50 and to prevent the weight 52 from moving within the cavity 50. Preferably, the cavities 50 and the weights 52 are positioned along the body 12 extending in a generally linear manner from the heel portion 12*b* to the toe portion 12*a* of the body 12.

Preferably, the cavities 50 are formed in the first surface 48 of the rear portion 40 so that the rear portion of the faceplate 18 is adjacent the first surface 48 to retain the weights 52 and/or plugs 54 within the cavities 50.

There is illustrated in FIGS. 4 and 5 a second embodiment of a putter head, indicated generally at 70. The putter head 70 is similar in structure and function as the putter head 10 described above. The putter head 70 includes a body 72 having a removable rear portion 74 attached thereto. The putter head 70 also includes removable faceplates 76. The body 72 has a stepped slot 78 formed therein defining a shoulder 80 for receiving and engaging an outwardly extending flange 82 formed around the perimeter of the faceplate 76. The faceplate 76 is attached to the body 72 by inserting the faceplate 76 through an open end 84 of the slot 78 located at a heel portion 72*a* of the body 72. A cap 86 is removably attached to the toe portion 72*a* of the body 72 to close off the open end 84 and retain the faceplate 76 in the slot 78. The cap 86 can be removably attached to the body 12 by any suitable manner, such as by a threaded fastener 88. Of course, the head 70 could be configured to include a cap for opening and closing off an open end at the heel portion of the head.

The putter head 70 is somewhat different than the putter head 10 described above in that a plurality of cavities 90 for receiving weights are formed in a rear surface 92 of the body 12. Thus, the rear portion 74 does not engage and contact the faceplate 76 to retain the weights within the cavities 90.

Figure 6:
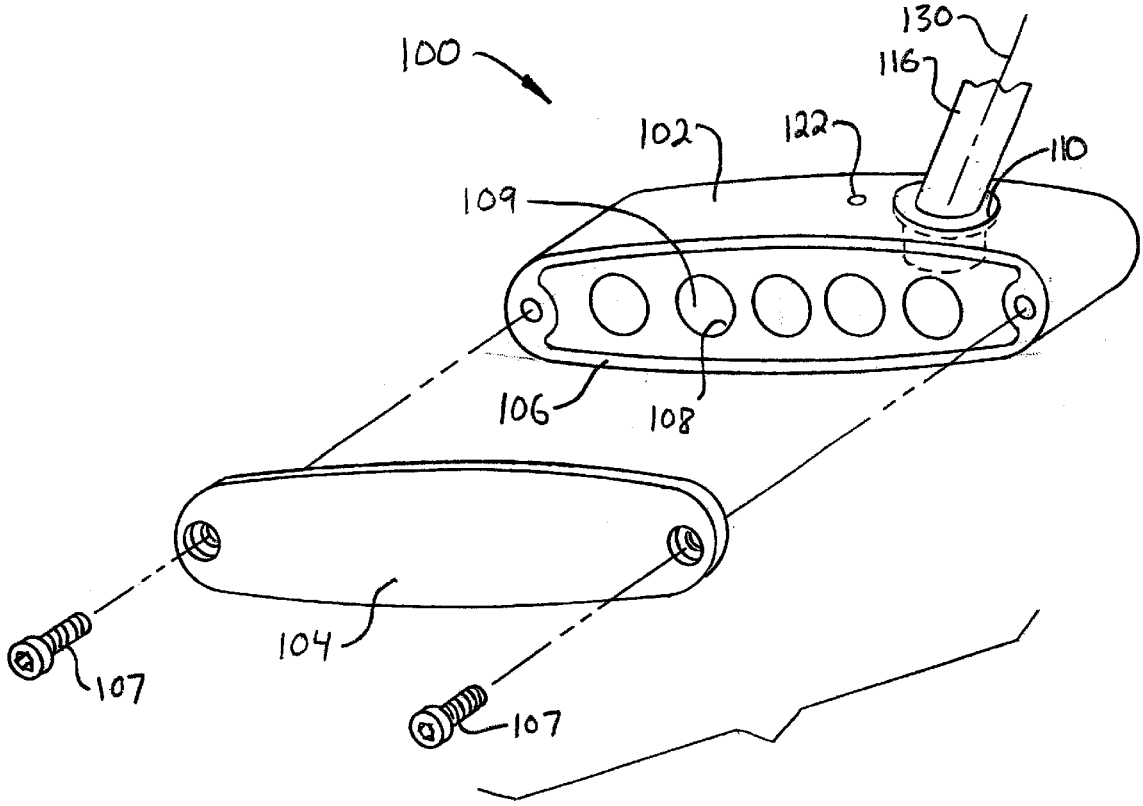
FIG. 6 is an exploded perspective view of a third embodiment of putter head, in accordance with the present invention.
Figure 7:
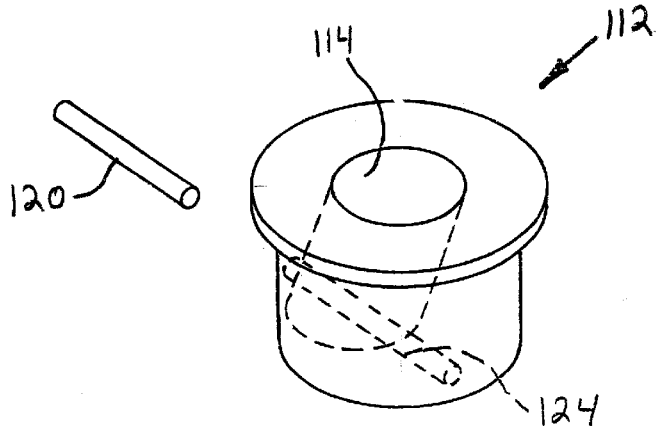
FIG. 7 is an enlarged perspective view of an insert for the putter head of FIG. 6.

There is illustrated in FIG. 6 a third embodiment of a putter head, indicated generally at 100. The putter head 100 is similar in structure and function as the putter head 10 described above. The putter head 100 includes a body 102 and removable faceplates 104 which are fastened to a front face 106 of the body 102, such as by threaded fasteners 107. The body 102 also includes a plurality of cavities 108 for receiving weights 109, similar to the cavities and weights described. The putter head 100 has a bore 110 formed in a top portion thereof. The bore 110 receives one of a plurality of inserts 112, as shown enlarged in FIG. 7. The inserts 112 have a bore 114 formed therein for receiving a shaft 116. The insert 112 can be fastened to the body 102 by any suitable manner, such as by a press-fit and/or by a pin 120 inserted into a bore 122 formed in the body 102 and a bore 124 formed in the insert 112. The bore 114 defines an axis 130 which generally corresponds to the lie-angle of the putter, commonly defined along the length of the shaft 116. The lie-angle of the putter can be adjusted by changing the insert 112 having the desired axis 116 of its bore 114.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A golf club head for attachment to a shaft, said head comprising:

a body adapted to be connected to a shaft, said body including a first portion adapted to be fastened to the shaft, and a second portion detachably fastened to said first portion, said second portion having a plurality of cavities formed therein for receiving weights;

one of a plurality of different faceplates adapted to be removably fastened to said body; and a plurality of individual weights, each of said weights separate from said faceplates, said weights being removably located within a separate one of said plurality of cavities to alter the weight characteristic of the golf club head.

2. The golf club head of claim 1, wherein said one of a plurality of faceplates is adjacent to and is in contact with said second portion.

3. The golf club head of claim 2, wherein said plurality of cavities are formed in a first surface of said second portion, and wherein said one of a plurality of faceplates is adjacent said first surface.

4. The golf club head of claim 1, wherein said first and second portions are detachably fastened by threaded fasteners.

5. The golf club head of claim 1, wherein said body has ends defining a heel portion and a toe portion, said plurality of cavities being oriented in a generally linear manner extending between said heel portion and said toe portion.

6. The golf club head of claim 1 further including a first weight inserted in a first cavity of said plurality of said cavities, wherein said size of said first weight is smaller than the size of said first cavity, thereby defining a void in said first cavity.

7. The golf club head of claim 6, wherein a plug is inserted in said void such that said first weight and said plug fills said first cavity.

8. The golf club head of claim 7, wherein said plug weighs less than said first weight.

9. The golf club head of claim 6, wherein said weight is made of a material which weighs more than the material of said body.

10. The golf club head of claim 6, wherein said plug is made of a material which weighs less the material of said weight.

11. The golf club head of claim 1, wherein said body includes a bore formed in an upper portion thereof, and head further comprising one of a plurality of inserts received in said bore, said insert having a second bore formed therein for receiving the shaft.

12. The golf club head of claim 1 wherein the golf club head is a putter head.

13. A golf club head for attachment to a shaft, said head comprising:

a body adapted to be connected to a shaft, said body having a first portion adapted to be fastened to the shaft, and a second portion detachably fastened to said first portion, said second portion having a plurality of cavities formed therein for receiving weights; and one of a plurality of different faceplates adapted to be removably fastened to said body, wherein said one of a plurality of faceplates is disposed between said first and second portions.

14. The golf club head of claim 13, wherein said one of a plurality of faceplates is unattached to either said first and second portions.

15. The golf club head of claim 13, wherein said body has a stepped bore formed therein defining a shoulder, and wherein said one of a plurality of faceplates has an outwardly extending flange engaging said shoulder.

16. The golf club head of claim 15, wherein said stepped bore defines an opening in a front face of said body, and wherein said one of a plurality of faceplates has a striking surface co-planar with said front face.

17. A golf club head for attachment to a shaft, said head comprising:

a body adapted to be connected to a shaft, said body having a slot and a plurality of cavities formed therein for receiving weights; and one of a plurality of different faceplates adapted to be removably fastened to said body, wherein said one of a plurality of faceplates is removably fastened to said body by sliding said faceplate in said slot, and wherein said one of a plurality of different faceplates defines a striking surface, and said slot extends in a direction substantially parallel to said striking surface.

18. The golf club head of claim 17, wherein said body includes a cap removably attached to said body, said cap closing off one side of said slot to retain said faceplate in said slot.

19. The golf club head of claim 17, wherein said slot is stepped defining a shoulder, said faceplate having an outwardly extending flange engaging said shoulder.

20. A golf club head for attachment to a shaft, said head comprising:

a body adapted to be connected to a shaft, said body having a plurality of cavities formed therein for receiving weights;

one of a plurality of different faceplates adapted to be removably fastened to said body; and a plurality of individual weights, each of said weights separate from said faceplates, said weights being removably located within a separate one of said plurality of cavities to alter the weight characteristic of the golf club head, and wherein said head further includes a first weight inserted in a first cavity of said plurality of said cavities, wherein said size of said first weight is smaller than the size of said first cavity, thereby defining a void in said first cavity.

21. The golf club head of claim 20, wherein a plug is inserted in said void such that said first weight and said plug fills said first cavity.

22. The golf club head of claim 21, wherein said plug weighs less than said first weight.

23. The golf club head of claim 20, wherein said weight is made of a material which weighs more than the material of said body.

24. The golf club head of claim 20, wherein said plug is made of a material which weighs less the material of said weight.

25. The golf club head of claim 20, wherein said one of a plurality of faceplates is adjacent to and is in contact with said second portion.

26. The golf club head of claim 25, wherein said plurality of cavities are formed in a first surface of said second portion, and wherein said one of a plurality of faceplates is adjacent said first surface.

27. The golf club head of claim 20, wherein said first and second portions are detachably fastened by threaded fasteners.

* * * * *